US008540314B2

(12) United States Patent
Fernandez

(10) Patent No.: US 8,540,314 B2
(45) Date of Patent: Sep. 24, 2013

(54) FLEX CHAIR

(75) Inventor: Juan Fernandez, Towaco, NJ (US)

(73) Assignee: Products of Tomorrow, Inc., Towaco, NJ (US)

( * ) Notice: Subject to any disclaimer, the term of this patent is extended or adjusted under 35 U.S.C. 154(b) by 283 days.

(21) Appl. No.: 12/912,960

(22) Filed: Oct. 27, 2010

(65) Prior Publication Data

US 2011/0095586 A1 Apr. 28, 2011

Related U.S. Application Data

(60) Provisional application No. 61/280,016, filed on Oct. 28, 2009.

(51) Int. Cl.
*A47C 9/00* (2006.01)

(52) U.S. Cl.
USPC ..... 297/314; 297/461

(58) Field of Classification Search
USPC ..... 297/313, 314, 325, 452.41, 461
See application file for complete search history.

(56) References Cited

U.S. PATENT DOCUMENTS

| | | | | | |
|---|---|---|---|---|---|
| 186,570 | A | * | 1/1877 | Huffman | 248/599 |
| 2,132,291 | A | * | 10/1938 | Fitos | 248/583 |
| 3,167,312 | A | * | 1/1965 | Blanchard | 482/128 |
| 3,309,137 | A | * | 3/1967 | Wiebe | 297/303.1 |
| 4,099,697 | A | * | 7/1978 | Von Schuckmann | 248/604 |
| 4,130,263 | A | * | 12/1978 | Roericht | 248/371 |
| 4,830,345 | A | * | 5/1989 | Mar | 267/133 |
| 4,932,719 | A | | 6/1990 | Gonzalez y. Rojas | |
| 5,044,587 | A | * | 9/1991 | Degen | 248/158 |
| 5,556,170 | A | | 9/1996 | Lai et al. | |
| 5,590,930 | A | * | 1/1997 | Glockl | 297/313 |
| 5,720,524 | A | | 2/1998 | Hall | |
| 5,746,481 | A | * | 5/1998 | Obermaier | 297/452.41 |
| 5,921,628 | A | | 7/1999 | Glockl | |
| 6,386,635 | B1 | | 5/2002 | Ralph | |
| 6,644,742 | B1 | * | 11/2003 | Walser | 297/314 |
| 2003/0209931 | A1 | | 11/2003 | Glaser | |

FOREIGN PATENT DOCUMENTS

| | | |
|---|---|---|
| KR | 10-0553414 | 2/2006 |
| WO | WO2009-123475 | 10/2009 |

OTHER PUBLICATIONS

PCT/US/2010/054392, Products of Tomorrow; PCT International Preliminary Report on Patentability; May 10, 2012.

* cited by examiner

*Primary Examiner* — Peter Brown
(74) *Attorney, Agent, or Firm* — Gearhart Law, LLC

(57) ABSTRACT

A chair having a seat, a first support base and an upright elongated support element. The upright elongated support element has a first point and a second point, with the first point connecting to the seat and the second point connecting to the first support base. The first support base is bolstered by a resilient component since the resilient component is disposed beneath the first support base. The resilient component is capable of providing cushioning to the first support base is also capable of providing a full axial rotation to said upright elongated support element.

8 Claims, 14 Drawing Sheets

FLEX CHAIR

CLAIM OF PRIORITY

This application claims priority to U.S. Ser. No. 61/280,016 filed on Oct. 28, 2009, the contents of which are fully incorporated herein by reference.

FIELD OF THE INVENTION

The invention relates to furniture, in particular, to a chair with a flexible support structure.

BACKGROUND OF THE INVENTION

The muscles of the human body tend to get tired when one is sitting in an uncomfortable position or in the same position for long periods of time. Humans sit most while working and discomfort is most noticeable during tasks requiring creativity or concentration. For this reason commercial and home office furniture usually includes multiple points of adjustment. Additionally, such furniture may have cushioning so as to lessen the reciprocal pressure that a supporting surface of a chair exerts on a sitter's body. Such chairs are generally able to rise and sink, lean back and swivel. Some, especially the more costly examples have adjustable armrests, lumbar supports, massagers and extra layers of cushioning.

DESCRIPTION OF THE RELATED ART

The relevant prior art involving adjustable chairs includes:

U.S. Pat. No. 5,921,628 issued on Jul. 13, 1999 that describes a "Pendulating Stool" that has a seat portion (1), an intermediate portion (13) and a base portion (2), wherein the intermediate portion (3) is mounted tiltably and returnably on the base portion (2). The intermediate portion (3) comprises a central pillar (4) and a spring structure (5). The central pillar (4) and the spring structure (5) are connected in series in the flow of force of the seat weight between the seat portion (1) and the base portion (2) and a bearing guide is provided between the central pillar (4) and the spring structure (5).

U.S. Pat. No. 4,932,719 issued to Gonzalez y. Rojas on Jun. 12, 1990 for an "Inclinable stool" that describes an inclinable stool for supporting the weight of the body and permitting a variety of inclined positions comprises a tripod base, supporting a vertically extending spring hinge assembly, a support column mounted on the spring hinge assembly and inclinable relative thereto, and a seat assembly disposed on the support column. A pair of spaced, stabilizing members, slidably and pivotally mounted to the support column, rotate with the seat assembly and support column, thereby supporting the seated user against backwardly directed inclinations while allowing forward and lateral inclinations, regardless of the rotated position of the seat.

U.S. Pat. No. 5,556,170 issued to Lai, et al. on Sep. 17, 1996 entitled "Sleeve structure of an office chair" that describes a sleeve structure of an office chair fitted around a pneumatic bar. The sleeve structure includes a sleeve body and a steel circular tube. The sleeve body is a plastic hollow flexible member, having a sleeve hole and two annular stoppers at two ends. Multiple (preferably 8 to 12) equally spaced axial ribs are arranged on the outer surface of the sleeve body and three equally spaced axial slits are formed on the sleeve body. Two polygonal (preferably hexagonal, heptagonal or octagonal) plastic fitting members are fitted in two ends of the steel circular tube to form an assembly. Each fitting member has an annular stopper at an end thereof. The assembly of the steel circular tube and the fitting members is forcedly fitted into the sleeve hole of the sleeve body by a machine and locked by the stoppers of the sleeve body. In turn the pneumatic bar is fitted into the steel circular tube with the angles of the fitting members tightly contacting with the pneumatic bar nearly without clearance existing there between. Then the sleeve body is fitted into a bar seat tube to form a support stem of the office chair. When the pneumatic bar suffers a load or a torque by different inclined angles, the office chair is always stably and safely supported by the support stem without swinging to keep a user comfortable.

U.S. Pat. No. 6,386,635 issued to Ralph on May 14, 2002 entitled "Shock absorbing boat seat assembly" that describes a shock absorbing boat seat assembly for providing a more comfortable ride upon a boat moving upon water. The shock absorbing boat seat assembly includes one or more seat members each having a seat and a backrest connected to the seat; and also includes one or more base assemblies for supporting one or more seat members with each of one or more base assemblies having a base member being adapted to securely mount upon a deck of a boat, and also having a boss-like support member securely disposed upon the base member and having a opening therein, and further having a hollow tubular member being movably disposed in the opening of the boss-like support member, and also having a shock absorbing assembly for absorbing shock, and further having a seat support member securely mounted upon the tube.

However, prior inventions suffer from drawbacks that the present device aims to redress. For example, the prior art devices are generally only able to lean back or stay upright. A user, who wishes to lean forward or to the side, will be required to shift into a less supportive and possibly less comfortable sitting posture. This is a significant drawback since the majority of tasks require some degree of reaching forward or to the side. This diminishes the effectiveness of comfort features since it forces people to lean away from comfort features provided by prior art chairs. The present invention resolves this drawback by providing a multidirectional leaning ability. A person need not alter his or her sitting position or posture to engage in such common tasks as leaning forward to look at a computer screen, leaning back while speaking on the phone, or leaning sideways to answer a phone call, communicate with a neighbor or to gaze out the window.

As an added convenience item, the present invention is capable to a limited automatic height adjustment without resorting the use of cranks, pneumatics or height adjustment pins, which are nonetheless included to provide additional height adjustment. This feature is based on the fact that a taller person will generally weigh more than a shorter person. The extra weight may cause a greater degree of contraction of the resilient component when exposed to the weight of a tall person rather than a short person. Thus a taller person may sit at a substantially equal level as a shorter person.

The present invention also provides a user with an ability to exercise torso muscles and lower limbs. One may take advantage of this feature by running a series of squatting or rocking exercises. The resilient component would then serve a dual role of a shock absorber and a tension element.

Various implements are known in the art, but fail to address all the problems solved by the invention described herein. One embodiment of this invention is illustrated in the accompanying drawings and will be described in more detail herein below.

SUMMARY OF THE INVENTION

The present invention discloses a chair having a seat, a first support base and an upright elongated support element. The upright elongated support element has a first point and a second point, with the first point connecting to the seat and the second point connecting to the first support base. The first support base is bolstered by a resilient component since the resilient component is disposed beneath the first support base. The resilient component is capable of providing cushioning to the first support base, and is also capable of providing a full axial rotation to said upright elongated support element.

Therefore, the present invention succeeds in conferring the following, and other not mentioned, desirable and useful benefits and objectives.

It is an object of the present invention to provide supportive yet substantially cushioned seating equipment.

It is another object of the present invention to provide seating equipment that is capable of leaning in all directions without tipping over.

Yet another object of the present invention is to provide a device that is capable combining both the rotational and the cushioning capability in a single element.

Still another object of the present invention is to provide a device where a standard wheeled base of a commonly used office chair may be enhanced with the present invention.

DESCRIPTION OF THE PREFERRED EMBODIMENTS

Figure 1:
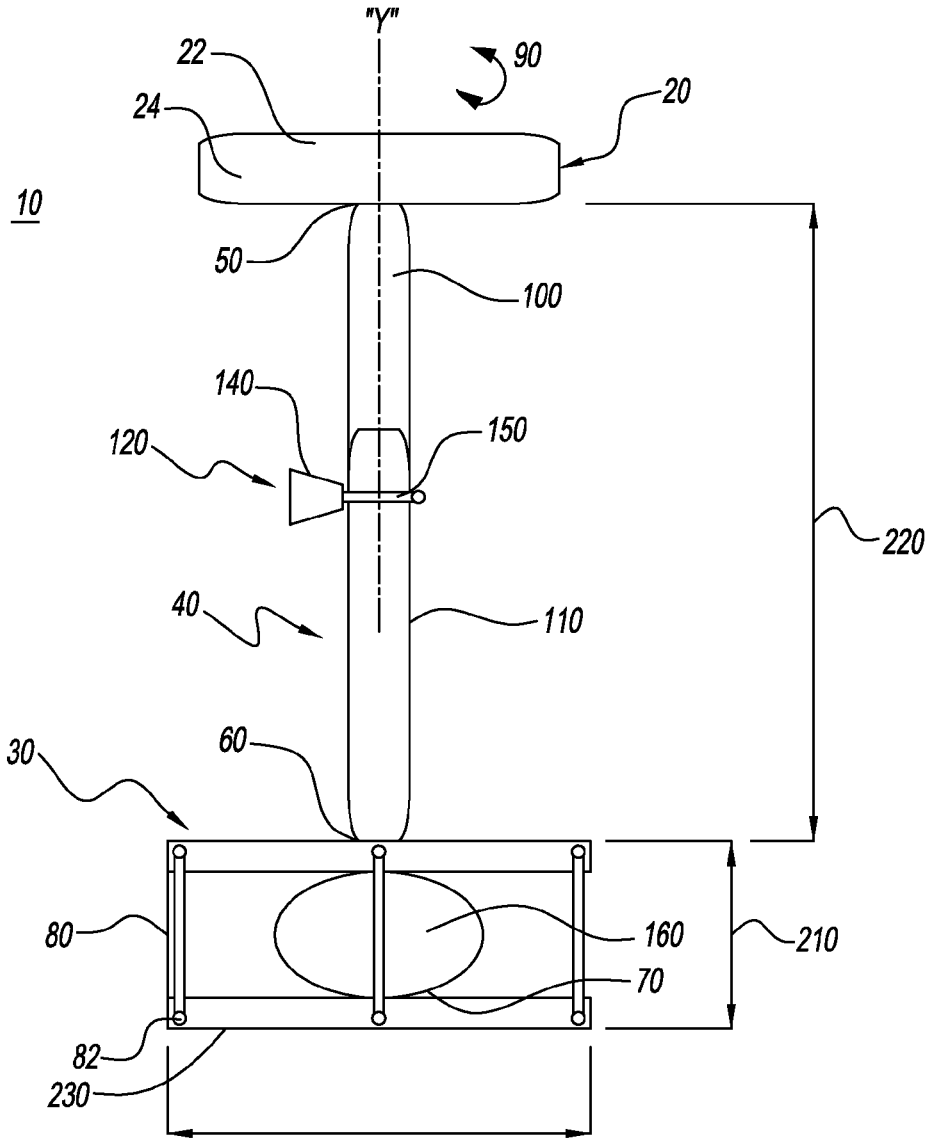
FIG. 1 is a cross-sectional side view of a preferred embodiment of the present invention.

The preferred embodiments of the present invention will now be described with reference to the drawings. Identical elements in the various figures are identified with the same reference numerals.

Reference will now be made in detail to embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Referring now to FIG. 1 shown is flex seat 10 having a seat 20, a first support base 30 and an upright elongated support element 40. The upright elongated support element 40 may have a first point 50 and a second point 60. The flex seat 10 also has a resilient component 70 that may be enclosed in the first support base 30. The first support base 30 may also have tension elements 80 that may be attached via fasteners 82. The upright elongated support element 40 may include a first telescoping member 100, a second telescoping member 110 and a tightening element 120. The tightening element 120 may, for instance, included a set screw 140 and a pin 150. The resilient component 70 may, for instance, include an elastic sphere 160.

In a preferred embodiment, a distance 220 between the first base support and the seat may be adjustable by means of the first telescoping member 100 and the second telescoping member 110. A distance 210 between the first support base 30 and a second support base 230 may vary dependant on a loading of the resilient component 70.

The seat 20, may be round or square or in any other shape. The seat preferably contains a seat cushion filling 24 that may be a cushioning material, such as, but not limited to synthetic and natural elastomers, such as a natural rubber, silicone rubber, poly-isoprene, or polystyrene or springs. Alternatively, the seat cushion filling 24 may be a jell-like substance, which may be an elastomer as well, or a liquid that is hermetically sealed. The seat 20 may additionally include a back portion or a back rest, with or without armrests (not shown). The upholstery for the seat's outer surface 22 may be any material commonly used in the art, such as, but not limited to vinyl, leather or plastic. The seat 20 may be able to axially rotate 90 about the axis of the upright elongated support element 40 or these components may be screwed-on, glued, welded, soldered, cramped or fastened together.

Figure 10:
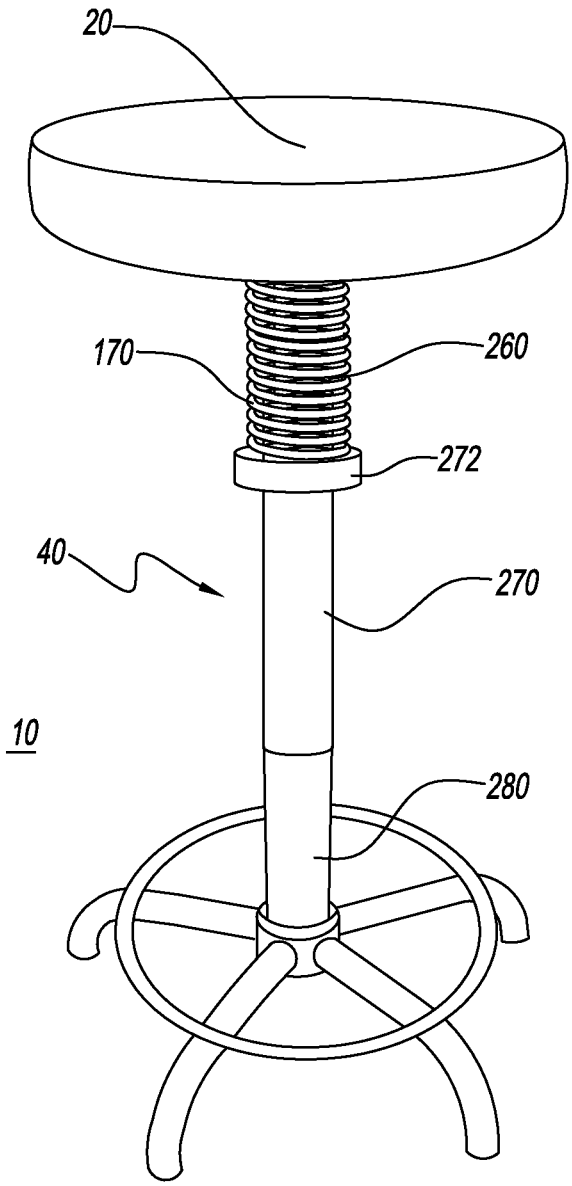
FIG. 10 is a view of the preferred embodiment shown in FIG. 9, without the outer shell.

The seat 20 may be supported by an upright elongated support element 40, which may have one or more sections for height adjustment. The upright elongated support element 40 (support element) may preferably be manufactured out of metal or metal alloy, but may also be made out of polymer or wood. Additionally the support element 40 may preferably be hollow and substantially tubular. Individual sections of a multi-sectioned upright elongated support element are capable of sliding in and out of each other. These sections may be made up of a first telescoping support member 100 and a second telescoping support member 110 that may slide or telescope within each other. A tightening element 120 may be used to secure first and second telescoping supports 100 and 110 at a desirable length. The tightening element 120 may be a set screw 140, a locking pin 150, O-clamp (not shown) or a threaded connection (not shown). A tightening knob, a lever, a pull handle, or a crank handle may be included. The first and second telescoping support member may also slide within each other using a gas cylinder, such as shown in FIG. 10. The first end 50 connects to the seat 20 while the second end 60 connects to the first support base 30.

The seat 20 may contain a socket 55 (FIG. 5) into which a first point 50 may be inserted. Alternatively a first point 50 may contain a flat perpendicular flange (not shown) having openings for fasteners that would secure the seat 20. The seat 20 preferably has a seat cushion filling 24 and a seat's outer surface 22.

The upright elongated support member 40 is supported by a first support base 30. The first support base 30 is preferably supported by a resilient component 70. The resilient component 70 is shown as being a sphere 160. A second support base 230 may be provided for stability of the article 10. Tension elements 80 ensure that the first support base 30 will not shift or slide off of the resilient component 70. The tension elements 80 are secured to the first support base 30 and to the second support 230 with fasteners 82. The tension elements 80 may extend and contract independently of each other. The tension elements 80 may be made be elastomeric or rubberized elastics or metallic springs. The tension force of the tension elements 80 is always kept at some positive value by the expansion or outward pressure of the resilient component 70. It follows that the resilient component 70 is preferably always slightly compressed due to the force exerted by the tension elements 80, while the tension elements are always slightly stretched due to the force of the resilient component.

The flex seat 10 is preferably swiveling, meaning that the seat 22 may rotate around the y axis as shown by the arrow 90. Swiveling is usually achieved by an upright axle surrounded by a washer or a ball bearing wheel (not shown). Components needed to accomplish the swiveling feature may be within the first point 50, the second point 60, or may be disposed within the resilient component 70. In the latter embodiment, the second point 60 would traverse the width of the first support base 30 and terminate in the swiveling mechanism disposed within the resilient element 70. The first support base 30 may be a round disc or may be embodied in any other shape. The first support base 30 affixes to the second point 60 of the upright elongated support element. The first support base 30 is preferably planar, but may be concave or convex as aesthetically or functionally desired.

Still referring to FIG. 1, the first support base 30 is shown supported by the resilient component 70. The resilient component 70 is preferably spherical 160 or may be embodied in any other shape such as a cylinder or a cube. The resilient component 70 may also a conventional metal or iron spring 170, as shown in FIGS. 5-8. Preferably, the resilient support 70 may be somewhat narrower than the width of the first support base. The preferred width or diameter 37 of the first support base 30 may be between 1 and 2.5 feet.

The resilient component 70 may be a rubber ball, or may be made from a flexible gel-like material, such as a silicone gel or styrene-ethylene/butylene-styrene (SEBS OR SEPS) or a thermoplastic elastomer (TPE), it may also be made from a natural or synthetic rubbers. The resilient component 70 is preferably centered beneath the first support base 30 and beneath the upright elongated support element 40. When subjected to pressure, the resilient component 70 is capable of compressing and deforming for extended periods of time. When pressure is removed, the resilient component 70 is able to assume its original form, without any memory of prior deformation.

Figures 4A, 4B, 4C, 4D:
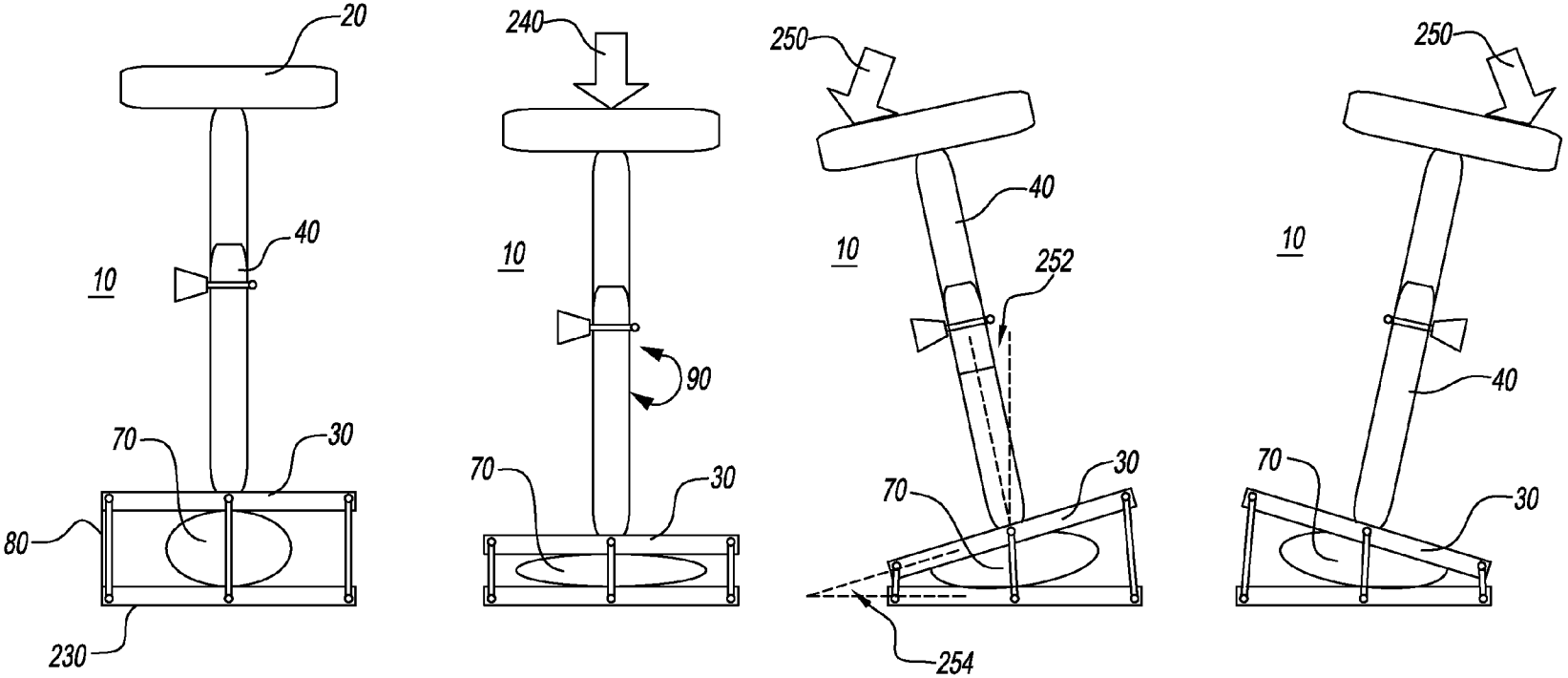
FIGS. 4A-4D illustrate the novel utility of the present invention.

A second support base 230 may be provided as well. The second support base 230 rests on a supporting surface such as a floor. The second support base 230 may be wider than the first support base 30 or may have the same shape and dimensions. It is preferable that the second support base 230 may be substantially flat so that it provides for a maximum support for the present invention. The outer edges of the first support base 30 and the second support base 230 may function as a positive stop point for maximum angle of deflection of the first support base 30. Meaning, the second support base 230 may prevent the present invention from toppling to the ground, when exposed to angled pressure 250 (FIGS. 4C, 4D). The second support base 230 may additionally contain legs, or wheels (not shown).

It is highly preferable to sandwich the resilient component 70 between the first support base 30 and the second support base 230. The two support bases may be tied together with a plurality of evenly spaced tension bands 80. The tension bands 80 may be elastic bands or extension springs. In such an embodiment, the base 210 is especially stable, because the resilient component 70, which is biased toward an outward expansion, is held under constant tension by the tension bands 80, which are biased towards contraction. The constant expansion force exerted by the resilient component 70 also serves to keep the tension bands 80 under a content tension.

The various parts of the present invention may be made from any material, including but not limited to: plastics and resins including but not limited to plastic, rubber, foam, silicone, ABS, Polycarbonate, Noryl™, PVC, Polystyrene, ABS/PVC, PVC/Acrylic, Poly-sulfone, Acrylic, Polyethylene, Kydex™, PETG; glass, including but not limited to fiberglass, borosilicate, or quartz; wood; metals, including but not limited to iron, tin, aluminum, copper; rubber including but not limited to natural rubber, SBR, Isoprene rubber, Butadiene rubber, and Chloroprene rubber; or any combinations or composites of these materials or other materials and new materials that may be manufactured in the future.

Figure 2:
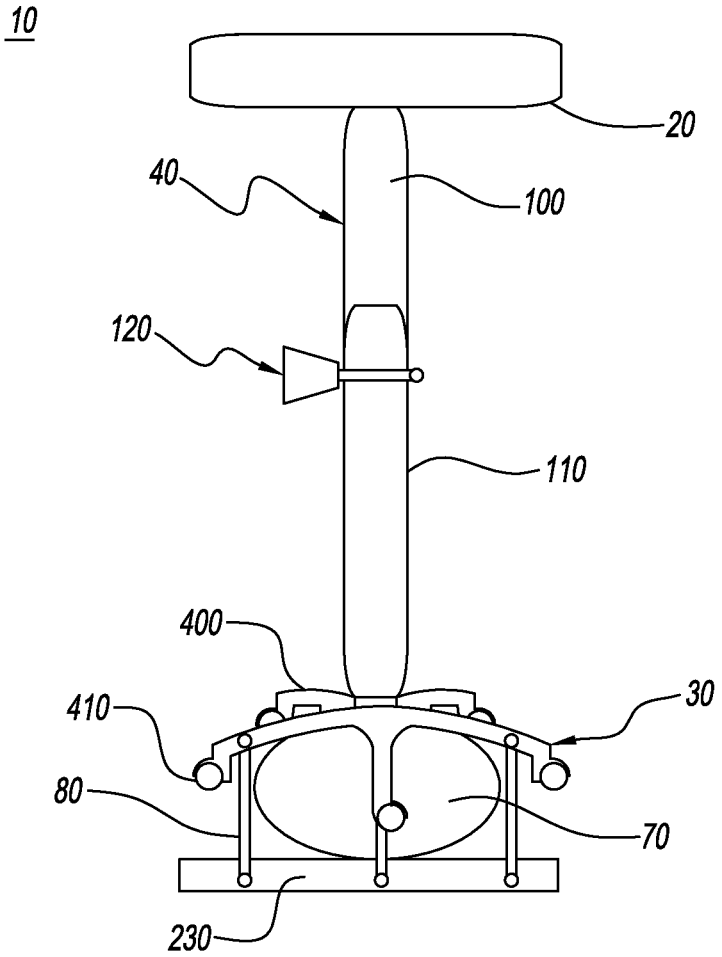
FIGS. 2 and 3 are cross-sectional side views of alternative embodiments.
Figure 3:
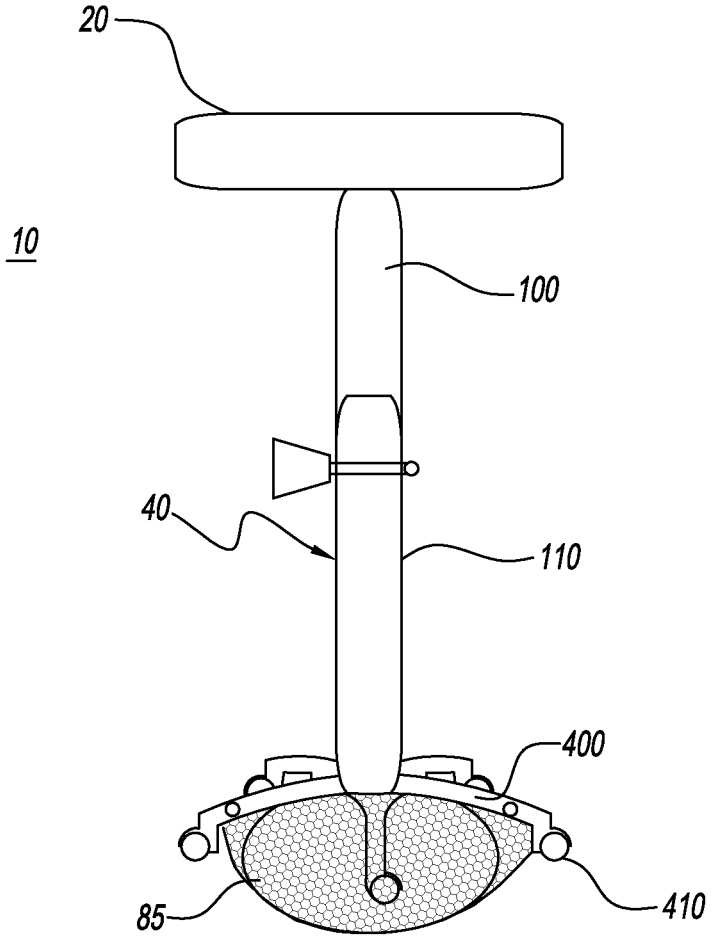

FIGS. 2 and 3 illustrate several alternatives to the embodiment shown in FIG. 1. Shown is a flex seat 10 having a seat 20, a first support base 30, an upright elongated support element 40, a resilient component 70 and a tension element 80. The upright elongated support element 40 has a first telescoping member 100, a second telescoping member 110 and a tightening element 120. The flex seat 10 may also have a first support base 30 second support base 230. The first support base 30 may be substantially flat or substantially convex, and may also be elliptical, square or rectangular, or any other shape.

FIGS. 2 and 3 illustrate how a conventional chair or stool may be easily converted into an embodiment of the present invention. The first support base 30 is shown in the shape of rays 400. Such a base is well known in the art and is commonly present in a majority of office chairs and other commercial or residential furniture. Often the rays 400 may feature wheels 410, which may remain in place after a conversion into an article 10 personifying the present invention. Such a first support base 30 may connect to the resilient component 70 with netting 85 or with tension bands 80. Also, in a ray shaped first support base 30, the rays may have special openings or hooks for tension elements 80 or for netting 85. Alternatively, the tension elements 80 or the netting 85 may contain loops that can be slipped over the rays 400.

FIGS. 4A-4D illustrate the affects of different load angles on the present invention.

FIG. 4A shows an unloaded flex seat 10 having a seat 20, a first support base 30, an upright elongated support element 40, a resilient component 70, tension elements 80 and a second support base 230.

FIG. 4B shows a flex seat 10 loaded with a centrally located, downward load 240. When a centrally located, downward load 240 is exerted on the seat 20, the first support base 30 may deform the resilient component 70 in a downward fashion.

FIGS. 4C and 4D show a flex seat 10 loaded with an angled load 250. Angular or partial deformation shown in FIGS. 4C and 4D is caused by the sideways leaning of the seat 20, which exerts an angular force or pressure 250. The deformation angle 254 may be equal to, greater then or less then, the deflection angle 252. During the deflection, the tension elements 80 on the deflection side would contract, while those on the side opposite to the deflection would expand. This expansion and contraction eventually reaches a maximum limit, at which point the seat 20 will not lean any further. The maximum expansion limit is preferably reached before the toppling point of the article 10. It is also highly preferable that the tension elements 80 and the resilient element 70 can withstand weights between 100 and 400 pounds.

The resilient component 70 may be inflatable and may provide a full axial swiveling capability 90 to the upright elongated support element 40. The swivel capability may be embodied in a resilient support 70 turning by itself, or by encompassing a central rod (not shown). Such a rod may be affixed within the first support base 30 and inserted into the center of the resilient component 70. The rod (not shown) would then swivel within the resilient component 70, and may have the same or similar elasticity characteristics as the resilient component 70. In another alternative, the upright elongated support element 40 may also swivel within the resilient component 70 without causing the resilient component 70 to rotate as well. This may be enabled if the upright elongated support element is encased in within a ball bearing gasket that may be present in a central rod or core of the resilient component 70. Alternatively, the entire resilient component may rotate in the same axial plane as the upright support element 40. The base 210 may additionally have exterior covering or upholstery (not shown). This covering may assist in holding the base 210 together or would be able to partially or completely conceal the resilient component 70.

Figure 5:
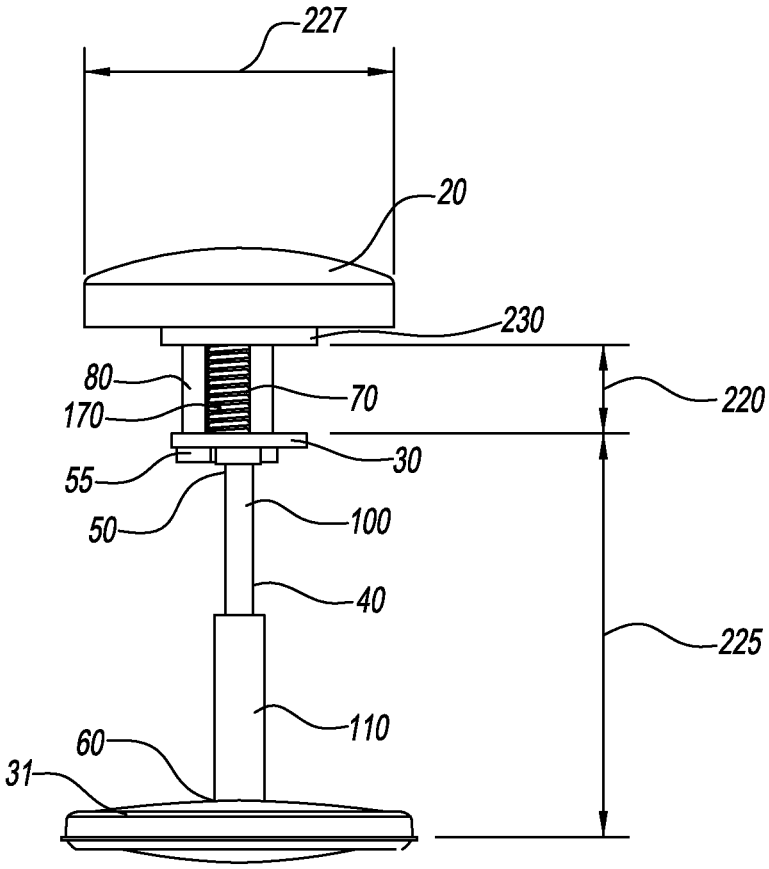
FIG. 5 is a side view of another preferred embodiment of the present invention.

FIG. 5 illustrates another preferred embodiment of the present invention. Shown is a flex seat 10 having a seat 20, a first support base 30 and an upright elongated support element 40. The upright elongated support element 40 may have a first point 50, a second point 60. The flex seat 10 may also include a resilient component 70 that may, for instance, be a conventional metal or iron spring 170 and tension elements 80. The upright elongated support element 40 may include a first telescoping member 100 and a second telescoping member 110.

In this embodiment, the seat 20 may be mounted directly on the resilient component 70 or on a second support base 230. The spring 170 may be the preferred embodiment of the resilient component 70 for the flex seat 10 as embodied in FIG. 5. The spring 170 may be mounted above the first support base 30. The first point 50 of the upright elongated support element 40 is affixed within the socket 55 at the bottom of the first support base 30. The second point 60 is mounted within the base 31. The first telescoping member 100 and the second telescoping member 110 are used for adjusting the height 225 of the first support base 30 above the base 31. The height 225 may vary between 1 and 3.5 feet, while distance 220 between the first base support and the seat vary between 2 and 6 inches between full compression and full extension respectively. The width 227 of the seat 20 may be between 0.75 and 1.5 feet, while the dimensions of the base 31 may be the same or slightly larger than that of the seat 20.

The base 31 may contain the swiveling capability. Alternatively, the seat may be swiveling with respect to the second support base 230. The functionality of the second support base 230 may be encompassed within the seat 20.

The tension elements 80 may link said first support base 30 and the second support base 230. Each tension element 80 may be capable of independent stretching or contracting. Independent extension and compression is necessary to support an angled load pressure on the seat 20 which may cause some tension elements 80 to contract and others to stretch.

Figure 6:
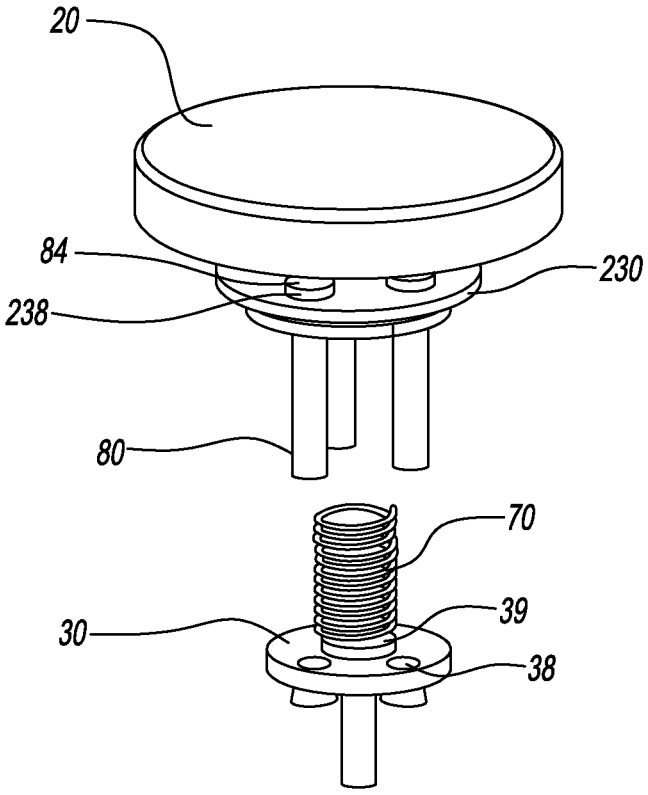
FIG. 6 is an exploded diagram of the embodiment shown in FIG. 5.

FIG. 6 is an exploded diagram of the upper part of the preferred embodiment shown in FIG. 5. Shown in FIG. 6 is a seat 20, a first support base 30, a resilient component 70, and tension elements 80. Also shown is a spring mounting protrusion 39, tension element openings 38, tension element caps 84, and sockets 238. The tension elements 80 are shown mounted within the sockets 232 of the second support base 230, and within tension element openings 38. The sockets 39 and openings 38 may contain adhesives or threading for fixating the tension elements 80. In an alternative embodiment, the tension elements 80 may be replaced with rods that provide an oblique structural support for the resilient component 70. Such tension elements 80 will be inflexible and function as shafts that slide up or down within the openings 38 as the spring 170 is compressed or released.

The resilient component 70 may be welded, crimped, frictionally attached, or attached with a screw thread to the mounting protrusion 39. In an alternative embodiment, a tension element may be incorporated within the spring 170. Such a tension element may be flexible or rigid. The second support base 230 functions as an upper mount point for the resilient component 70, the tension elements 80, and the seat 20. Alternatively, the second support base 230 may be omitted, with the seat 20 functioning as the mount point.

Figure 7:
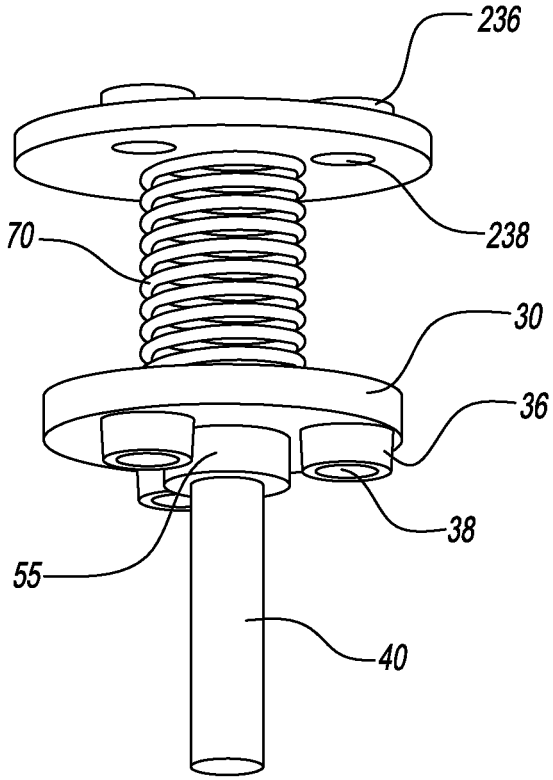
FIGS. 7 and 8 are detailed views of a preferred embodiment of the resilient component.
Figure 8:
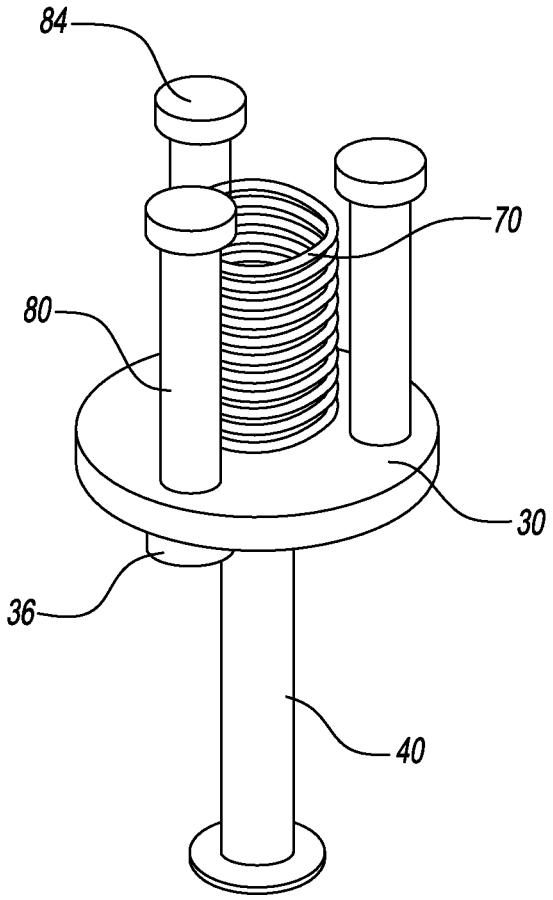

FIGS. 7 and 8 provide a detailed view of the preferred embodiment shown in FIG. 5. Shown is a first support base 30 an upright elongated support element 40, a resilient component 70, tension elements 80, and tension element caps 84. The tension element caps 84 may be affixed to the tension elements 80 with threading, and are used to secure the tension elements 80 within the second support base 230. Also shown are tension element openings 38 and sockets 238. The sockets 238 may further contain lips 36 and 236 respectively. The lips 36 and 236 may provide an additional area for adhesives or threading. The lips 36 and 236 may also be used to retain a lubricant in an embodiment where the tension elements 80 are shafts. Preferably, there are three tension elements 80. However, other embodiments may feature fewer or additional tension elements 80.

Figure 9:
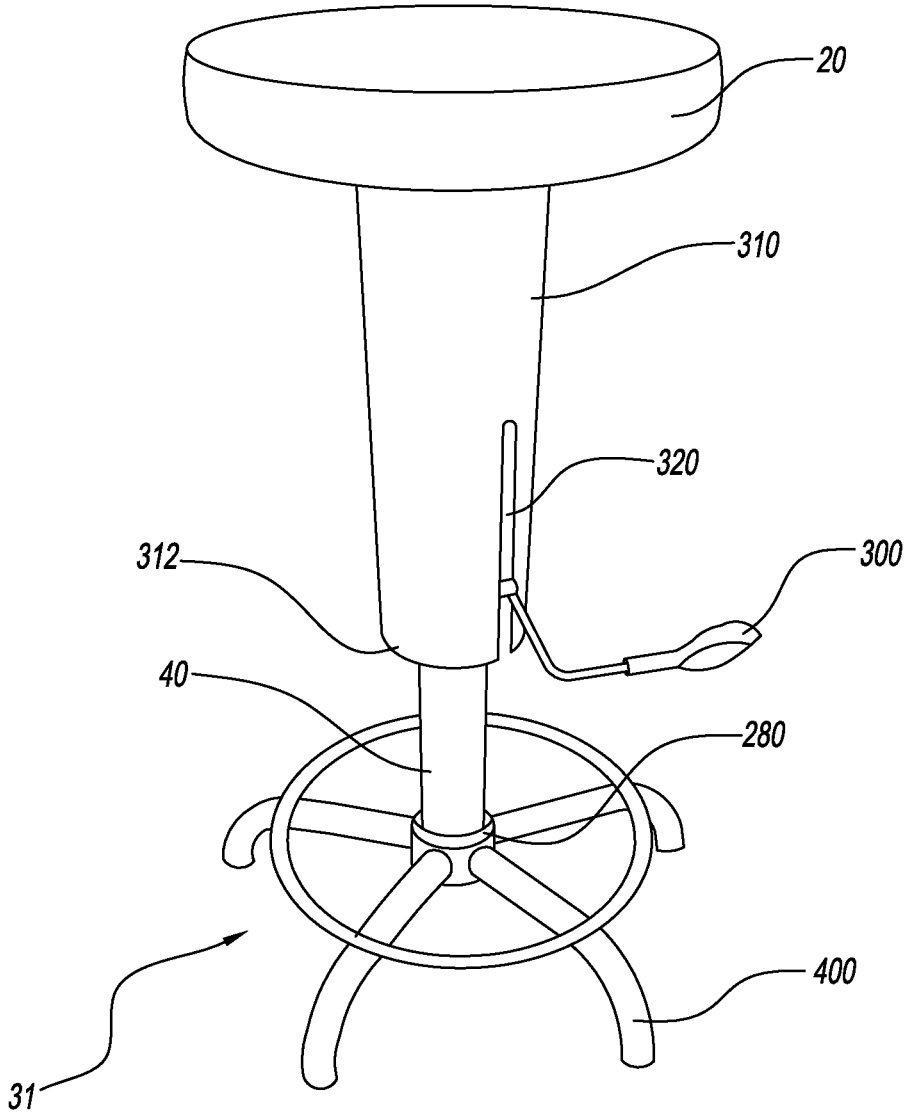
FIG. 9 is another preferred embodiment of the present invention.

FIG. 9 illustrates a third preferred embodiment of the present invention. A flex seat 10 may have a seat 20, an upright elongated support element 40, a base 31, a second portion 280, an adjustment lever 300, an outer casing 310, and a slit 320. The seat 20 may swivel independently or together with the cylinder 270 (FIG. 10).

An outer casing 310 or jacket surrounds the upright elongated support element 40. The bottom rim 312 of the casing 310 may span all or part of the height of the elongated support element 40. The casing 310 is preferably mounted on the seat 20 and moves up and down with it. A slit 320 may be provided to accommodate the adjustment lever 300. The base 31 may have conventional leg rays 400 as are common in this class of furniture. The rays 400 may contain wheels 410 (FIG. 2, 3). Alternatively, the embodiment shown may have a base 31 as described in, for instance, the descriptions of FIG. 1 or FIG. 8.

FIG. 10 illustrates the embodiment shown in FIG. 9, without the external casing 310 or the adjustment lever 300. Shown are a seat 20, a spring 170, a cylinder 270, an exterior flange 272, a second portion 280, a first end 290 and a base 31. In this embodiment the upright elongated support element 40 is preferably made from three sections. The first portion 260 is a top section that supports the seat 20. The first portion 260 is slidably disposed within a cylinder 270, meaning it telescopes into an out of the cylinder 270. The cylinder 270 may be a gas or an oil cylinder or contain a combination of components. The cylinder 270 is capable of sliding up and down the second portion 280; meaning, it is in a slided association with the second portion 280. This sliding is controlled with a lever 300 that activates a transfer of gas or oil from one chamber within the cylinder 270 to another, thus causing the cylinder 270 to slide up or down the second portion 280.

Shown also is a flange 272 that may be present on the exterior surface of the cylinder 270. The flange 272 supports the resilient component 70, in this case, a spring 170. The spring 170 affords extra cushioning and suppleness. Note, that in this embodiment, an angled load will not cause the seat 20 to compress at an angle, as in embodiments shown in FIGS. 1 and 5. Rather the compression and extension of the elongated support element 40 is limited to an up and down adjustment of the cylinder 270 and telescoping of the first portion 260.

Figure 11A:
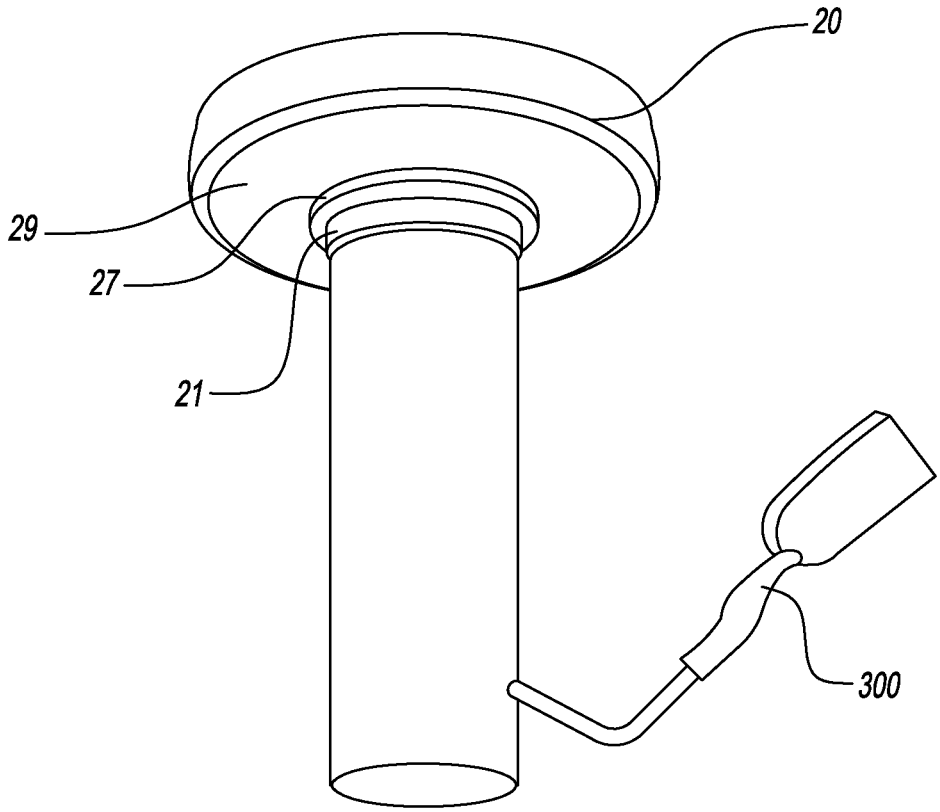
FIGS. 11A-11C are side views of the embodiment illustrated in FIG. 9.
Figure 11B:
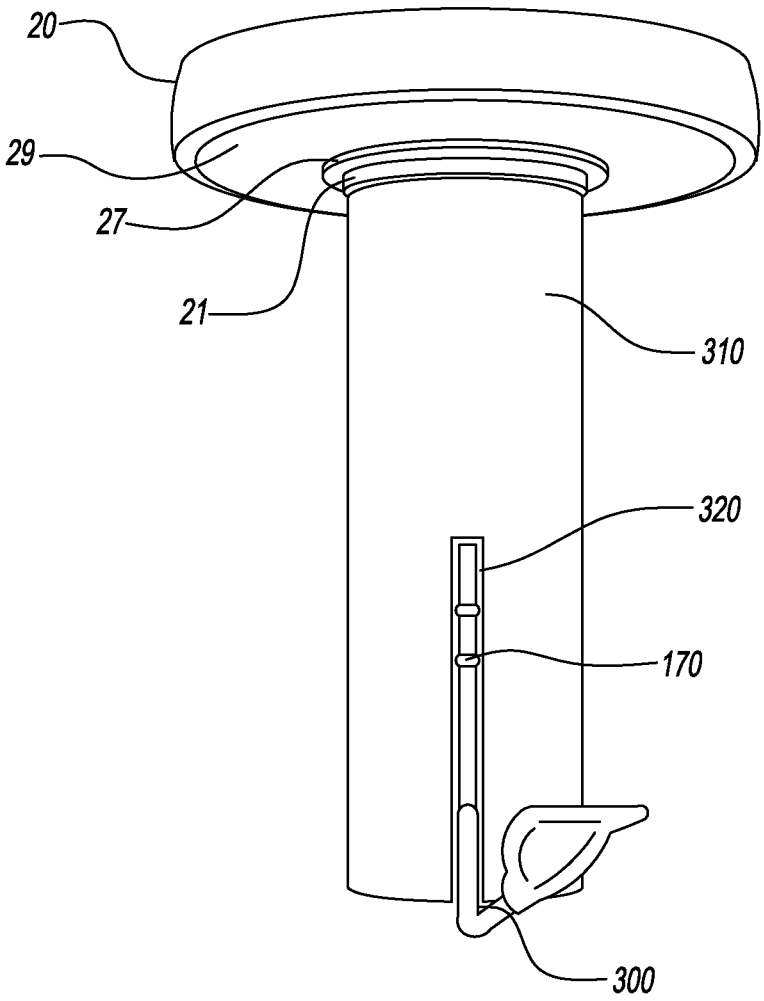
Figure 11C:
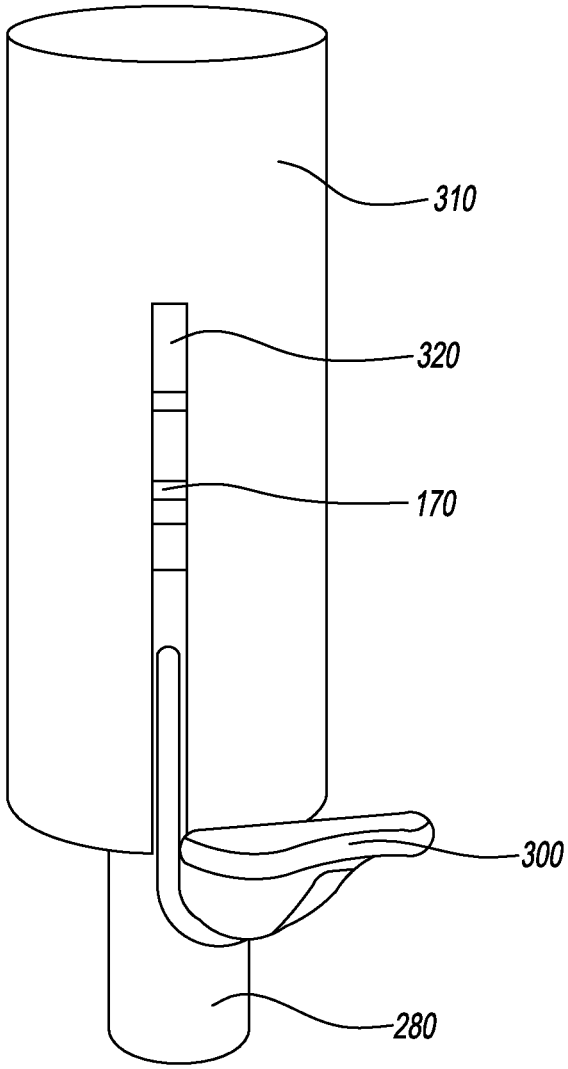

FIGS. 11A-11C are a close up illustration of the cover. Shown are a seat 20, a bottom face of the seat 29, a casing mount area 27, a swiveling section 21, a casing 310, an adjustment lever 300, slit 320, a second portion 280, a spring 170, and a base 210. The swiveling section 21 may contain ball bearing within a gasket enabling the seat 20 to rotate about the casing 310, or the first section 260 (FIG. 10). Alternatively, both the seat 20 and the casing 310 swivel as a single unit. The casing 310 may be welded or attached with fasteners or adhesives to the bottom face 29 of the seat 20.

Figure 12:
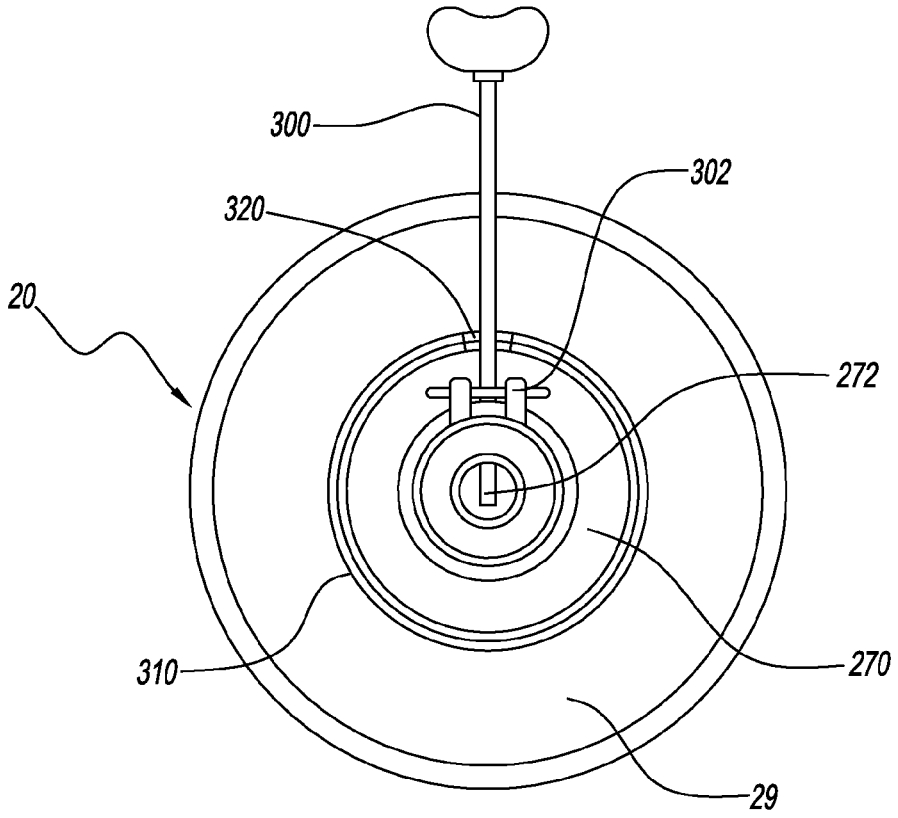
FIG. 12 is a bottom view of the elongated upright support, a height adjustment lever, and the outer shell.

FIG. 12 shows the bottom view of the seat 20. Shown also is the cylinder 270 with a cylinder opening 272. The cylinder opening is mounted on top of the second portion 280 (FIG. 10). The lever 300 protrudes through a slit 320 and terminates inside the cylinder 270. The lever 300 may have a pivot point 302 which may be spring loaded. The spring loaded pivot point 302 may ensure that the lever returns to a previous position after the seat 20 has been raised or lowered.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. An article of manufacture comprising:

a seat;

a first support base;

an upright elongated support element having a first point and a second point, said first point connecting to said seat and said second point connecting to said first support base;

a resilient component, said resilient component being disposed beneath said first support base, and said resilient component being capable of providing cushioning to said first support base;

a second support base disposed beneath the resilient component; and at least two tension elements, each said tension element linking said first support base and said second support base, each said tension element being capable of independently stretching and contracting, wherein the resilient component deforms to allow the upright elongated support element and the seat to tilt relative to vertical axis, the tension elements prevents shifting and sliding of the first support base from the resilient component, and outer edges of the first support base and second support base function to stop further tilting of the upright elongated support element and the seat.

2. The article of manufacture of claim 1, wherein said upright support element is further comprised of a first telescoping member; a second telescoping member; and a tightening element, wherein said first telescoping member and said second telescoping member are capable of slidably fitting within each other, and wherein said tightening element is capable of securing said upright support element at a particular height.

3. The article of manufacture of claim 2, wherein said tightening element is selected from a group comprising a set screw, a spring loaded pin, a lockable insert pin.

4. The article of manufacture of claim 1, wherein said first support base has a convex shape, wherein said first support base is capable of partially wrapping around said resilient component.

5. The article of manufacture of claim 1, wherein said resilient component is an elastic sphere.

6. The article of manufacture of claim 1, wherein said resilient component is a spring.

7. The article of manufacture of claim 1, further comprising a back member, wherein said back member has a height adjuster.

8. The article of manufacture of claim 7, wherein said back member further comprises armrests.

* * * * *